United States Patent [19]

Baker et al.

[11] 3,961,941

[45] June 8, 1976

[54] METHOD OF PRODUCING METALLIC LEAD AND SILVER FROM THEIR SULFIDES

[75] Inventors: Richard D. Baker, Osburn, Idaho; Stephen M. Cottam, Bountiful, Utah; Howard E. Day, Silverton; William A. Griffith, Osburn, both of Idaho

[73] Assignee: Hecla Mining Company, Wallace, Idaho

[22] Filed: May 19, 1975

[21] Appl. No.: 578,745

[52] U.S. Cl. ..... 75/101 R; 75/104; 75/118 R; 75/120; 75/21; 204/66; 423/40; 423/98

[51] Int. Cl.[2] ..... C22B 1/02; C22B 11/04; C22B 13/04

[58] Field of Search ..... 75/101 R, 118 R, 120, 75/21, 104; 204/66; 423/40, 98

[56] References Cited

UNITED STATES PATENTS

| | | | |
|---|---|---|---|
| 1,434,087 | 10/1922 | Christensen | 204/66 |
| 1,441,065 | 1/1923 | Christensen | 204/66 |
| 1,539,714 | 5/1925 | Christensen | 75/120 X |
| 2,655,472 | 10/1953 | Hilliard | 75/120 X |
| 3,929,597 | 12/1975 | Cottam et al. | 75/109 |

*Primary Examiner*—G. Ozaki
*Attorney, Agent, or Firm*—Wegner, Stellman, McCord, Wiles & Wood

[57] ABSTRACT

A process for producing metallic lead and silver from materials such as ores and concentrates containing the corresponding sulfides and particularly a mixture of minerals such as galena and tetrahedrite in which process the minerals are initially roasted under neutral conditions which include a non-oxidizing or even slightly reducing atmosphere at an elevated temperature for a time equivalent to about 1.5 hours at about 550°–600°C. to produce a roasted mineral product in which the roasting causes certain unidentified changes but with the resulting roasted product being more easily leachable so that the process of removing the silver and lead can be greatly simplified. The leaching and separating of the silver and lead includes subjecting the neutral roasted material to a ferric leach such as with an aqueous solution of ferric chloride to convert the lead and silver sulfides to lead and silver chloride, then subjecting the solid residue from this first leaching to a second leaching with aqueous sodium chloride brine to dissolve these lead and silver salts followed by separating the lead and silver salts from the brine leached material to leave a final solid as a final residue that may be discarded and then separating the lead and then the silver from the filtrate that contains the lead and silver salts.

12 Claims, 1 Drawing Figure

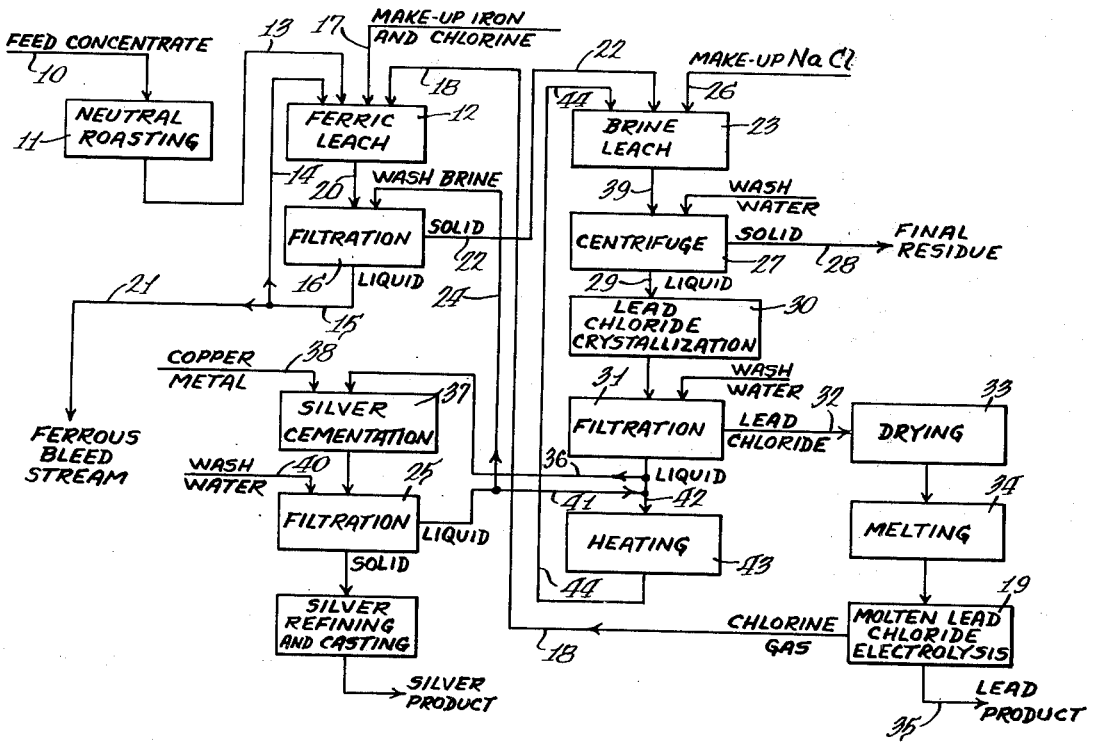

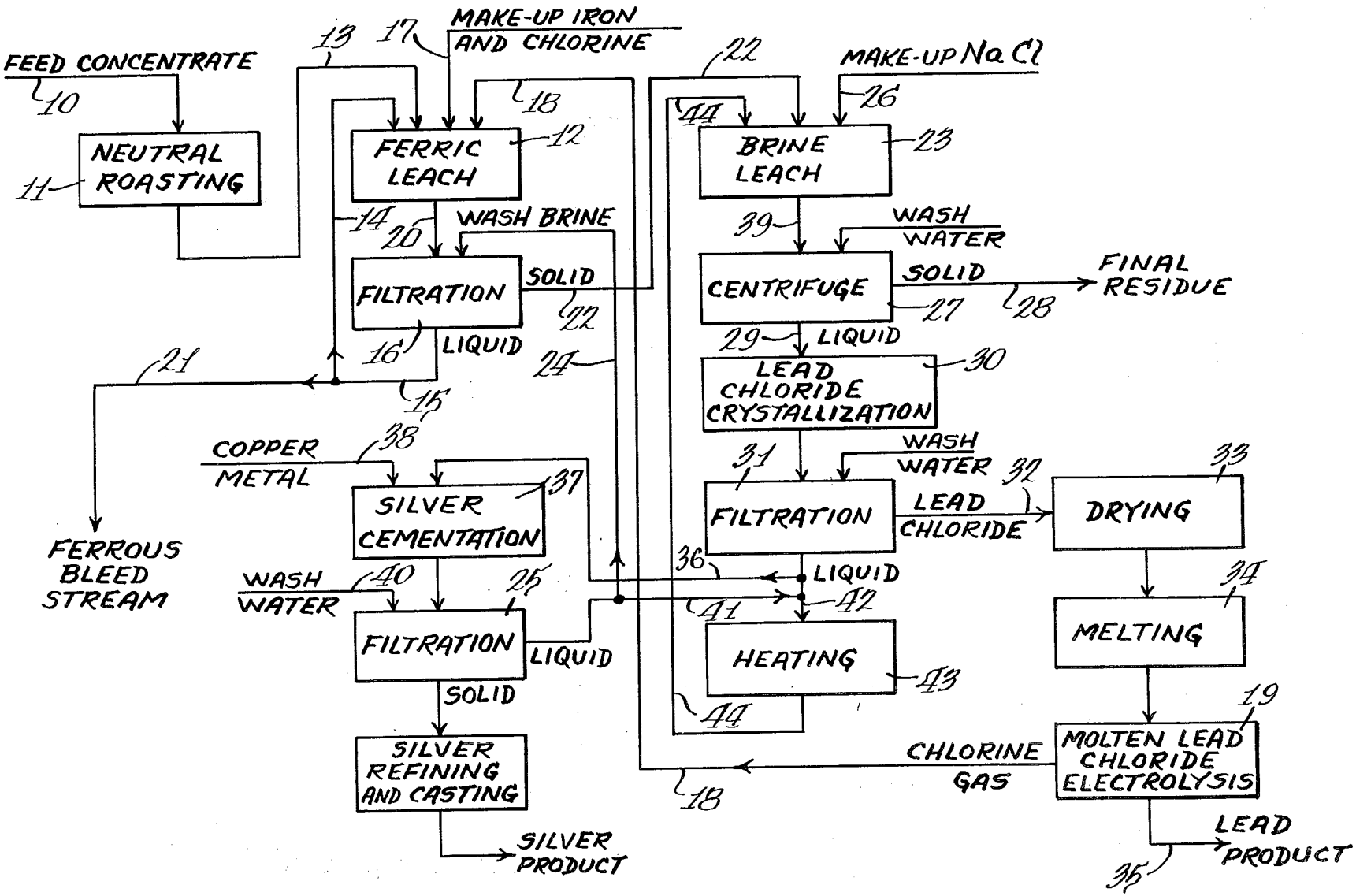
FEED CONCENTRATE
10
NEUTRAL ROASTING
11
13
MAKE-UP IRON AND CHLORINE
17
FERRIC LEACH
12
14
18
WASH BRINE
20
SOLID
22
24
FILTRATION
16
LIQUID
15
21
FERROUS BLEED STREAM
MAKE-UP Na Cl
26
BRINE LEACH
23
22
44
WASH WATER
39
CENTRIFUGE
27
SOLID
28
FINAL RESIDUE
LIQUID
29
LEAD CHLORIDE CRYSTALLIZATION
30
WASH WATER
31
FILTRATION
36
LIQUID
42
LEAD CHLORIDE
32
DRYING
33
MELTING
34
MOLTEN LEAD CHLORIDE ELECTROLYSIS
19
LEAD PRODUCT
35
CHLORINE GAS
HEATING
43
41
44
18
COPPER METAL
38
SILVER CEMENTATION
37
WASH WATER
40
FILTRATION
25
LIQUID
SOLID
SILVER REFINING AND CASTING
SILVER PRODUCT

METHOD OF PRODUCING METALLIC LEAD AND SILVER FROM THEIR SULFIDES

BACKGROUND OF THE INVENTION

In a copending application of Cottam, Day and Griffith, three of the inventors here, Ser. No. 470,719, filed May 17, 1974, now U.S. Pat. No. 3,929,597 there is disclosed and claimed a lead and silver process in which the feed material such as ores and concentrates containing lead and silver sulfides are subjected to a more complex recovery process in which during the treatment the unroasted feed material or concentrate is subjected to successive treatments that include a first ferric leach, a second ferric leach, a first brine leach, a second brine leach and sodium sulfide leach leading to metallic lead and metallic silver. In the present process wherein the feed concentrate is first subjected to a neutral roasting which is at an elevated temperature and non-oxidizing atmosphere, certain chemical changes in the feed concentrate which are not understood as to their chemical nature take place so that the lead and silver ingredients are much more easily separated with the result that the process is greatly simplified in that the sodium sulfide leach, the second ferric leach and the second brine leach can be eliminated. Also, the percentage of silver and lead that are recovered are extraordinarily high. Thus in some embodiments the percentage of available silver in the feed concentrate is 97% recovered and the amount of lead is 99% recovered.

Thus this invention relates to the production of lead and silver metal from their sulfide materials such as ores and concentrates in a simplified process including as an essential step the roasting of these sulfide materials in a non-oxidizing atmosphere which can be reducing if desired at an elevated temperature followed by a ferric leach and then a brine leach of the resulting solids after which the filtrate which contains dissolved lead salt and dissolved silver salt is further treated to separate the lead and silver salts from the filtrate and from each other and the resulting solid is discarded as a final solid residue.

Other features and advantages of the invention will be apparent from the following description of one embodiment.

SUMMARY OF THE INVENTION

This invention is related to the production of metals from their ores and concentrates. It is particularly adapted to the production of lead and silver metals from sulfide flotation concentrates containing a mixture of minerals such as galena (PbS) and tetrahedrite $[(Cu,Fe,Zn,Ag)_{12}(Sb,As)_4S_{13}]$.

The purpose of this invention is to provide a novel means by which the lead and silver values contained in sulfide ores and concentrates may be extracted and converted to commercial grade metals. A further object of the invention is to produce said metals without the discharge of gaseous or aqueous pollutants in quantities likely to violate present or foreseeable environmental restrictions on industrial plant effluents. It represents an improvement over prrevious known processes in that the feed sulfide sulfur is believed to be converted into elemental sulfur rather than into a sulfur dioxide gas and produces lead metal of marketable quality rather than a contaminated lead requiring further processing for recovery of silver and removal of copper, arsenic and other impurities. Silver is recovered easily and simply during the process by extraction from an aqueous solution and the only waste products of the process are small volume liquid streams which may be easily purified, impounded or recycled.

Description of the Prior Art and Advantages Thereover

The leaching of sulfide minerals in ferric chloride solutions to produce metal chlorides and elemental sulfur is a well known process. An example would be the attack of $FeCl_3$ containing solutions on galena (PbS).

$$PbS + 2FeCl_3 \rightarrow PbCl_2 + 2FeCl_2 + S^o$$

Similar reactions may be written for any mineral sulfide. The produced metal chlorides may be dissolved in the leach solution or in a subsequent leach with water or a solution of an alkaline earth chloride such as NaCl or $CaCl_2$.

One problem with the above process is that while some minerals such as galena are rapidly attacked by ferric solutions, other sulfides such as tetrahedrite and sphalerite are not. In cases where the tetrahedrite contains a considerable quantity of silver, this is a definite disadvantage since one would normally want to recover that precious metal in any commercial operations. The resistance of zinc to attack by ferric may be advantageous since, in many commercial operations involving the production of lead sulfide concentrate, zinc is an impurity of minor value which can cause excess ferric consumption in converting it to the metal chloride and it would be best from an economic standpoint to leave the metal in the sulfide form.

This invention provides a means by which lead and silver values may be effectively extracted from a concentrate or ore containing lead, silver and zinc with only minor extraction of said zinc values.

Modern industrial practice for the production of lead metal from sulfide ores anc concentrates usually involves feeding said ore or concentrate to a sintering machine where, by contact with air at an elevated temperature, the majority of the sulfide sulfur is converted to sulfur dioxide gas and the lead is converted to a metal oxide, sulfate or silicate. The solids product from the sintering operation is mixed with coke and fed to a blast furnace where any remaining sulfur is converted to gaseous sulfur dioxide and the lead is reduced to the metallic state. Any silver in the feed ore or concentrate will report with the lead metal as will varying quantities of copper, bismuth, arsenic and antimony, all of which must be extracted from the molten lead before it may be classified as a commercial grade metal. In this connection see Bray, John L., Non-Ferous Production Non-Ferrous New York: John Wiley & Sons, Inc., 1941, pp. 208–255.

A principal objection to the traditional means of lead production is the emission of sulfur dioxide containing gases from the sintering and blast furnace operations. Present and expected government regulations require that this sulfur dioxide be removed from the effluent gas before it may be expelled to the atmosphere. The sulfur dioxide may be converted to sulfuric acid, but this often proves expensive, especially with the low strength gas produced during lead smelting operations. Furthermore, if no market or use can be found for the acid, it must be disposed of by neutralization or other means which are expensive. An alternate route for the disposal of sulfur dioxide is to convert such to elemental sulfur, through the use of a reductant like natural gas. THe produced sulfur may be easily impounded and stored as a solid waste, but this process is also expensive. Facilities to produce either sulfuric acid or elemental sulfur do not recover all the sulfur dioxide and the final effluent gas from such plants may still require further cleaning of the gas by some means. An improved process for lead production would produce elemental sulfur directly from the sulfide mineral and thus avoid any expense associated with the removal of sulfur dioxide from gas streams.

A second objection to the traditional lead process is the necessity of purifying the molten lead metal after its production in the blast furnace. The hot, bulky, molten lead must be transferred, stored and treated in a multitude of process steps to recover silver and extract copper, arsenic, bismuth and other impurities or the metal may be cast into anodes and electrorefined. An improved lead process would involve recovery of silver and removal of impurities before actual production of lead metal so that purification of the bulk metal, once produced, would be unnecessary.

BRIEF DESCRIPTION OF THE DRAWING

The single FIGURE of the accompanying drawing is a process flow chart of one embodiment of the invention with legends as well as numerals indicating the various stages or steps in the emobdiment process.

DESCRIPTION OF THE PREFERRED EMBODIMENT

In the embodiment illustrated in the drawing a feed concentrate identified by the flow line 10 is neutral roasted as indicated at 11 at an elevated temperature and under non-oxidizing conditions which means in the essential absence of oxygen or even in the presence of a slightly reducing gas. This neutral roasting may be at a temperature of 525°–900°C. for a time equivalent to about 1.5 hours at about 550°–600°C. The roasting time may be as short as one-half hour at the higher temperatures and may be for more than 1½ hours although no particular advantage has been noted for longer periods of roasting.

The invention is particularly applicable to the production of lead and silver metals from sulfide flotation concentrates containing a mixture of minerals such as galena and tetrahedrite as noted above. The neutral roasting is believed to alter or destroy the tetrahedrite chemical structure in the feed concentrate 10 in preparation for leaching with an aqueous ferric salt solution such as ferric chloride leaching as indicated at 12. The neutral roasting makes the tetrahedrite mineral readily leachable by a ferric salt aqueous solution such as ferric chloride solution while the unroasted tetrahedrite mineral is not so leachable. Galena, on theother hand, is readily leachable by aqueous ferric chloride solution even without the roasting but the feed concentrate contains a mixture of these minerals as well as other possibly non-silver and lead containing materials.

From the neutral roasting 11 the roasted concentrate is directed through a line 13 to the ferric leach 12 where it is leached with an aqueous solution of ferric chloride supplied partially by a line 14 from a filtrate line 15 leading from a filtration unit 16. As can be seen from the flow chart the ferric chloride solution is also generated within the ferric chloride leach unit 12 not only by the filtrate from line 15 supplied through the line 14 but also from make-up iron and chlorine from the line 17 and additional make-up chlorine gas from the line 18 with this gas being generated at the molten lead chloride electrolysis unit 19 to be described in greater detail hereinafter.

The ferric chloride leaching solution in the unit 12 contains from about 10–752 grams per liter of ferric chloride in aqueous solution or a maximum of about 260 grams per liter of ferric solution made from ferric chloride to express the maximum in different terms. Thus one example would be about 500 grams per liter of ferric chloride. This first leaching in the aqueous water soluble ferric salt solution at the unit 12 is preferably at a temperature of about 50°–100°C. for about 1 to 6 hours, one example being 75°C. for 3 hours, which converts the metal sulfides to their water soluble chloride salts by the following chemical reactions:

$$PbS + 2FeCl_3 \rightarrow PbCl_2 + 2FeCl_2 + S^{\circ}$$

$$Ag_2S + 2FeCl_3 \rightarrow 2AgCl + 2FeCl_2 + S^{\circ}$$

Similar reactions may be written for zinc, iron and the like minerals contained in the roasted feed concentrate as these are also converted to their water soluble chloride state.

The ferrous chloride produced in this step is regenerated to the ferric state with the chlorine gas which may be obtained as described above from the make-up line 17 as well as from the molten lead chloride electrolysis unit 19 through the chlorine gas line 18. As shown on the chart, this regeneration of the ferric ion can take place at the same time and in the same tank or unit 12 as the leaching of the roasted concentrates or, if desired, the regeneration can be done in a separate equipment stage as indicated at 13 in the above copending application Ser. No. 470,719 which is assigned to the same assignee as is the present application.

Due to the constant recycling of the dissolved salts as indicated by the flow lines 15 and 14 as well as the line 20 leading from the leach unit 12 to the filtration unit 16, the feed leach solution into the leach unit 12 is saturated with lead and silver chlorides and these salts produced during the leach form part of the residue which is collected by filtration. Zinc and iron and any other chloride soluble metals dissolved during the ferric leach 12 are soluble in the solution and are carried along with the filtrate from the filtration unit 16.

Although this filtrate is recirculated through the unit 12 as shown on the flow chart by the lines 15, 14 and 20 a portion of this filtrate is withdrawn from this circuit by way of the line 21 and discarded as a ferrous bleed stream to get rid of dissolved zinc and other impurities. The iron that is contained in the bleed stream 21 is replaced by dissolved iron contained in the feed concentrate 10 or, if the concentrate 10 is not sufficient in iron content to account for the bleed stream loss, it may be replaced with make-up iron supplied through the line 17 as previously described.

The second leaching in the illustrated process comprises a brine leach. Thus the solid residue from the filtration unit 16 is directed through a line 22 to a brine leach unit 23 where this solid residue is leached in an aqueous solution containing about 250–350 grams per liter of sodium chloride, of which 300 grams per liter is a typical example, at between about 50°–100°C., e.g., 75°C., for between about 0.5 and 2.0 hours, e.g., 1 hour.

The amount of leaching solution in this second leach needs only to be that required to dissolve the lead and silver chlorides produced in the first leach 12. Because both zinc and iron are detrimental to the solubility of lead in the brine and this would have a bad effect on the brine leach 23 the solid filter cake in the filtration unit 16 is washed with brine supplied by the line 24 with this line being supplied with wash brine froom the filtration unit 25 that forms a part of the silver recovery system to be described hereinafter. This washing of the filter cake from the filtration unit 16 prevents the zinc and iron ions from contaiminating the brine in the brine leach 23 thereby requiring excessively large quantities of brine solution to dissolve the lead and silver chlorides. In order that there will be an adequate supply of sodium chloride in the brine leach 23 additional amounts of make-up sodium chloride are supplied by way of the line 26.

In the next step the clear hot solution which is rich in lead and silver chlorides is directed through a line 39 to a centrifuge 27 where the solids are separated from the solution and discarded as a final solid residue through a line 28. The liquid from the centrifuge 27 is directed through a line 29 to a lead chloride crystallization unit 30 where it is cooled to a temperature below the solubility temperature for the lead chloride, one example being below about 25°C., which causes the dissolved lead chloride to crystallize from solution and these lead chloride crystals are filtered from the resulting liquid in a filtration unit 31 and the solid lead chloride is directed through a line 32 to a drying unit 33 from whence the dried lead chloride is melted as indicated at 34 and the molten lead chloride subjected to electrolysis 19 from which step the resulting lead, which is of very high purity that does not require further purification before commercial use, is separated as indicated by the line 35 and the chlorine gas by-product is directed through the line 18 into the first leach 12 which, as explained, is the ferric leach to regenerate fresh ferric chlorides in situ.

A portion of the brine solution from the filtration unit 31 and after the lead chloride crystallization and separation 32 is directed by way of a line 36 into a silver cementation unit 37 where it is contacted with metallic copper supplied through a line 38 to produce cement silver by the following well known reaction:

$$2Ag^{+} + Cu^{o} \rightarrow 2Ag^{o} + Cu^{++}$$

This well known silver cementation may be accomplished by mixing the solution portion from the line 36 in an agitated tank with the copper metal 38 which may be copper powder. As is well known the resulting slurry would be filtered in unit 25 to collect the silver metal that is produced which is washed with water from line 40. The liquid filtrate from units 25 and 31 through lines 41 and 42 are combined and heated in a heating unit 43 and then supplied through a line 44 as make-up liquid to the brine leach unit 23, previously described.

Another and equally well known alternative would be to contact the solution from the line 36 with copper plates or rods on which silver would be deposited and from which the cement silver would be removed by intense solution agitation followed by collection by filtration. In any situation, the resulting cement silver would then be refined in the well known manner and cast into bars of commercial grade silver.

As can be seen from the above description taken in conjunction with the accompanying flow diagram the only waste products of the process are a small volume liquid stream identified at 21 as the ferrous bleed stream (which may be easily impounded or purified for recycle) and an insoluble final residue indicated at 28 in the flow diagram (which may also be impounded).

The silver sulfide in the feed mineral is difficult to convert to a water soluble salt form where it can be dissolved and the resulting solution used to generate metallic silver as by cementation. Thus, as is illustrated in the above Cottam et al. application Ser. No. 470,719 the mineral is conducted through successive stages including a first ferric leach, a first brine leach to dissolve most of the silver chloride produced in the first ferric leach, then rhe remaining solids are subjected to a sodium sulfide leach and then to a second ferric leach and a second brine leach before it can be concluded that all of the initial silver sulfide has been converted to the corresponding chloride and dissolved in the brine solution. In contrast to this, the preliminary roasting under non-oxidizing conditions causes some unidentified changes in the feed mineral or concentrate so that only a signle ferric leach is required to convert the silver sulfide into silver chloride and only one brine leach is required to dissolve this silver chloride so that the silver can later be generated therefrom as by silver cementation. Not only is this a considerable saving in equipment, time, labor and space requirements but, as noted above, the recovery of the silver from the original mineral feed is remarkably high, approaching 100%.

The ferrous bleed stream 21 may be purified before disposal and this can be done as follows:

Silver may be removed from the ferrous bleed stream by cementation on copper in the same manner as silver was removed from the brine leach solution by silver cementation.

Copper and lead may be removed from the bleed stream by cementation on iron by the following reactions:

$$Cu^{++} + Fe^{o} \rightarrow Cu^{o} + Fe^{++}$$

$$Pb^{++} + Fe^{o} \rightarrow Pb^{o} + Fe^{++}$$

The operation would employ iron powder or scrap iron in agitated contact with the solution. The resulting slurry would then be clarified by filtration to produce a low grade lead-copper product which may be recycled to the ferric leach 12.

Zinc and iron may be removed from the ferrous bleed stream by precipitation with sulfide ions or a neutralizing agent such as sodium carbonate. Typical reactions would be as follows:

$$Zn^{++} + S^{=} \rightarrow ZnS$$

$$Fe^{++} + S^{=} \rightarrow FeS$$

$$Zn^{++} + Na_2CO_3 \rightarrow ZnCO_3$$

$$Fe^{++} + Na_2CO_3 \rightarrow FeCO_3$$

The resulting slurry would be filtered and the solids either sold or impounded.

After the above step the bleed stream solution will have lost most impurities except for its sodium chloride content. This solution may be recycled as a portion of the wash water in the second or brine step or the solution evaporated from the remaining salts and the dry salts impounded.

The above procedure for bleed stream treatment and disposal is by no means the only conceivable method by which this operation might be accomplished and the invention is not limited to the use of it. Any process which will convert the bleed stream into disposable, marketable or recycleable products may be employed.

Two experimental examples will now be presented which will demonstrate the effectiveness of the neutral roasting procedure in rendering silver more amenable to attack by the ferric choride solution. The feed material was a flotation concentrate produced by Hecla Mining Company at the Lucky Friday mine near Mullan, Idaho and analyzed 69.4% lead, 96.2 oz/ton silver and 6.1% zinc. The principal minerals present were galena, tetrahedrite and sphalerite.

TEST 1 — UNROASTED CONCENTRATE 75 grams of the feed concentrate was leached in 286 ml of a 752 grams per liter ferric chloride solution for 2 hours at 50°C. and the resulting slurry filtered and washed with 50 ml water. The resulting filter cake was leached in 3.0 liters of a 300 grams per liter sodium chloride solution for 0.5 hours at 70°C. The resulting slurry was filtered. The leach residue thus produced weighed 26.7 grams and analyzed 6.6% lead, 136.52 oz/ton silver and 11.5% zinc.

TEST 2 — ROASTED CONCENTRATE 120 grams of the feed concentrate was placed in a 2-inch diameter by 18-in laboratory kiln which was heated to 900°C. and rotated at 20 rpm for 1.5 hours while a stream of nitrogen gas was passed through the kiln. The charge was then allowed to cool and 75 grams of the resulting concentrate leached as in Test 1. The final residue from this test weighed 26.0 grams and analyzed 2.1% lead, 7.44 oz/ton silver and 14.6% zinc.

The metal extractions for the two tests are as follows:

| | | Metal Extraction - % | | |
|---|---|---|---|---|
| | | Pb | Ag | Zn |
| Test 1 | Unroasted Concentrate | 96.6 | 49.5 | 32.9 |
| Test 2 | Roasted Concentrate | 98.9 | 97.3 | 17.0 |

The neutral roasting of the concentrate produced three advantageous results: (1) the lead extraction was increased, (2) the silver extraction was considerably increased, and (3) the zinc extraction was decreased. This third unexpected advantage of the process will decrease the quantity of make-up chlorine needed in the ferric leach. Ferric ion consumed by lead sulfide during the ferric leach is regenerated by an equivalent quantity of chlorine produced in the molten salt electrolysis cell, but any ferric consumed by other sulfide minerals such as zinc sulfide must be regenerated by purchased make-up chlorine which is expensive. In cases where the zinc content of the feed concentrate is of minor economic value, as in the example cited here, it is better to allow that metal to report in the final residue of the process which might be marketed as a low grade zinc concentrate rather than to attempt to dissolve that zinc into solution.

As can be seen by a comparison with the above-identified previously filed application Ser. No. 470,719, many of the individual steps here are similar to those described in this previous application. These include the silver metal separation, the lead metal separation, the disposal of the final residue and the disposal of the ferrous feed bleed.

Having described our invention as related to the embodiment set out herein, it is our intention that the invention be not limited by any of the details of description, unless otherwise specified, but rather be construed broadly within its spirit and scope as set out in the appended claims.

We claim:

1. In the method of producing metallic silver and elemental sulfur from a mineral material comprising silver sulfide, the improvement comprising: roasting said material under substantially non-oxidizing conditions at an elevated temperature of about 525°–900°C. for a time equivalent to about 1.5 hours at about 550°–600°C. to produce a roasted product; first leaching said roasted product in an aqueous water soluble ferric salt solution containing ferric ions to produce the corresponding solid silver salt and elemental sulfur; subjecting said solid silver salt to a second leach with aqueous sodium chloride brine solution to produce the corresponding soluble silver chloride dissolved in the solution and a solid residue comprising said elemental sulfur; and separating said dissolved silver salt from said elemental sulfur.

2. The method of claim 1 wherein said solid silver salt and elemental sulfur are separated from the liquid from the ferric salt leaching and this liquid is directed to the first leach and combined with added chlorine to regenerate ferric leaching solution in said first leaching.

3. The method of producing lead and silver from minerals including a mixture of lead and silver sulfides, comprising: roasting said minerals under substantially mon-oxidizing conditions at an elevated temperature of about 525°–900°C. for a time equivalent to about 1.5 hours at about 550°–600°C. to produce a roasted mineral product; first leaching said product in an aqueous water soluble ferric salt solution containing ferric ions to convert said sulfides to the corresponding salts of said lead and silver; second leaching the solid residue from this first leaching with aqueous sodium chloride brine solution to dissolve said salts and produce a lead and silver salts solution and a further solid residue; separating and discarding said further solid residue; cooling the said salt solution to crystallize and thereby separate said lead salts; removing the lead salt crystals from the remaining silver salt solution; and generating metallic silver therefrom.

4. The method of claim 3 wherein said aqueous ferric salt solution contains about 10–225 grams per liter of ferric ions as ferric chloride.

5. The method of claim 3 wherein said first leaching is at about 25°–100°C. and for about ½–4 hours to convert said insoluble metal sulfides to the insoluble salts corresponding to said ferric salt.

6. The method of claim 3 wherein said first leaching solution comprises ferric chloride.

7. The method of claim 3 wherein said lead and silver sulfides present are reacted with sufficient ferric ions to produce the lead and silver salts corresponding to the ferric salts that supply said ferric ions together with free sulfur.

8. The method of claim 3 wherein said residue from said first leaching is repeatedly contacted with a recycled aqueous solution of said water soluble ferric salt for converting substantially all said sulfides to the corresponding salt prior to said second leaching with the sodium chloride brine solution.

9. The method of claim 8 wherein a portion of the filtrate from said ferric leaching is ejected as a ferrous ion bleed stream to compensate volumetrically for the amount of brine leaching solution that is introduced, thereby preventing an indefinite buildup of water soluble impurities in the recycled ferric solution.

10. The method of claim 3 wherein the brine solution of said second leaching contains about 250–350 grams per liter of sodium chloride, and said second leaching is for about ½–2 hours at a temperature of about 50°–100°C.

11. In the production of lead and silver metals from minerals including a mixture of galena and tetrahedrite containing lead and silver sulfides by leaching said minerals with an aqueous water soluble ferric salt solution followed by further leaching the solids from this first leach with an aqueous sodium chloride brine solution preparatory to separating the lead and silver salts, the improvement comprising: preliminarily roasting said minerals under substantially non-oxidizing conditions and at an elevated temperature and for a time equivalent to about 550°–600°C. for 1.5 hours.

12. The method of claim 11 wherein said roasting temperature is about 525°–900°C.

* * * * *